United States Patent [19]

Chu-Hwa

[11] Patent Number: 4,717,155

[45] Date of Patent: Jan. 5, 1988

[54] LADLE-BALL RACKET

[76] Inventor: Hsu Chu-Hwa, 6th Fl., No. 424 Cherng Teh Road, Taipei, Taiwan

[21] Appl. No.: 890,158

[22] Filed: Jul. 28, 1986

[51] Int. Cl.[4] ..... A63B 59/00

[52] U.S. Cl. ..... 273/322; 273/325

[58] Field of Search ..... 273/322, 323, 325, 326, 273/328, 321

[56] References Cited

U.S. PATENT DOCUMENTS 2,754,123 7/1956 Davidson ..... 273/321

*Primary Examiner*—William H. Grieb

*Attorney, Agent, or Firm*—Asian Pacific International Patent & Trademark Office

[57] ABSTRACT

A ladle-ball racket with a receiving ladle and a serving ladle, a passage permitting rolling of a ball between the receiving ladle and the serving ladle, used to receive the ball with the receiving ladle, serving the ball with the serving ladle after the ball received by the receiving ladle has reached the serving ladle through the ball passage.

3 Claims, 4 Drawing Figures

LADLE-BALL RACKET

BACKGROUND OF THE INVENTION

The present invention relates to a racket for receiving and serving a ball.

There are many favorite ball games in the world. They are popular mainly because of their nature of entertainment, physical training and competition, simple rules of game, simple apparatus and playing on any field as well as a formal court.

At the moment, the favorite games include soccer, basketball, American football, volleyball, rugby, water polo, dodge ball, tennis, table tennis, badminton, golf, baseball, hockey, billiards, bowling, etc. They are popular mainly because of the above mentioned factors. Their sport population is increasing day by day.

Apparatus for each of these games are very simple. For soccer, basketball, American football, rugby dodge ball, water polo and the like, only a ball is required in addition to a court, for tennis, table tennis, badminton, golf, hockey, billiards, bowling and the like, each player requires only a racket or club or bat in addition to a court, and for baseball, each player requires a mitten, too.

None of the apparatus for the above games can be used for service, receiving and stopping of a ball. A racket, club or bat is used to hit or trap the ball in motion but none of them can stop a ball. Therefore, a game is always played rapidly and keenly, and most games are not suitable for the aged or heart disease patients.

If a ball can be trapped and then stopped for a while before it is thrown into a given direction with a strength the player thinks fit according to his experience and wisdom, the rhythm of game can slow down. Furthermore, it allows a player to control a hit, direction and strength in good timing, and make the process of a game an enjoyable experience. Then, a game will have intellectual, lasting pending, interesting and rhythmic features.

SUMMARY OF THE INVENTION

The main object of the present invention is to provide a ladle-ball racket which can be used for both ball receiving and serving as well as to hold a ball in it.

Another object of the present invention is to provide a ladle-ball racket which allows stopping of a plurality of balls in its ball passage, simultaneously.

Another of the present invention is to provide a ladle-ball racket which is simple and economic in design and easy to produce.

A ladle-ball racket to accomplish the aforesaid object has a form substantially like a long ladle with a grip at the lower end, a serving ladle at the upper end and a receiving ladle in the middle, and a ball passage between the serving ladle and receiving ladle.

A player can use the receiving ladle in the middle to trap a ball moving toward him, let the ball move through the ball passage into the serving ladle, and he can counter strike immediately, or let the ball stop there for a while and then throw the ball at any time he thinks fit.

BRIEF DESCRIPTION OF THE DRAWINGS

A person skilled in the art will duly be aware of the aforesaid and other objectives, characteristics and advantages of the present invention from description and drawings for an embodiment given below.

DETAILED DESCRIPTION

Figure 1:
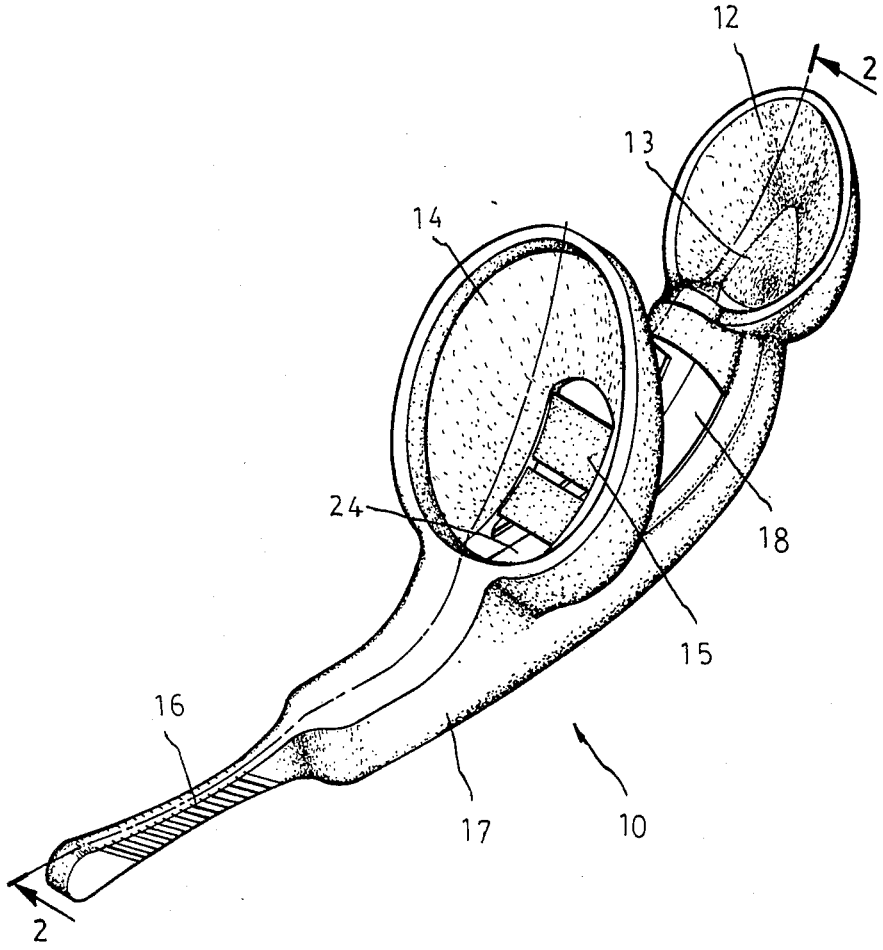
FIG. 1 is a perspective view of the present invention and illustrates a ladle-ball racket.

As shown in FIG. 1, the racket (10) is a form substantially of a long ladle mainly composed of a grip (16), a serving ladle (12) at the top, a receiving ladle (14) in the middle, and a ball passage (18) between the serving ladle (12) and receiving ladle (14).

The receiving ladle (14) is located below the serving ladle (12) at a position that will never obstruct path of the ball from the serving ladle (12). Therefore, the receiving ladle (14) must be located at an arm (17) at the middle of the racket (10). The receiving ladle (14) is in a form substantially like a ladle with an opening (24) permitting passing of the ball at the lowest end. A plurality of belts (15) are used to form the bottom of the receiving ladle (14).

The ball passage (18) is substantially in the upper half on the arm (17). It has a cross sectional area just permitting rolling of the ball but preventing the ball from falling down from the racket (10). An end of the ball passage (18) is just below a hole (24) of the receiving ladle (14). and another end of the ball passage (18) has an opening (25) connecting it directly to the serving ladle (12).

The serving ladle (12) is in a form substantially like a ladle located on the top of the arm (17) and ball passage (18). Its bottom (12) is like a bowl to form a ball seat (13) below the surface of the ball passage (18).

The grip (16), the arm (17) and the serving ladle (12) of the racket (10) are substantially located along a smooth curved line so that the racket can be waved easily and smoothly by a player.

Figure 2A:
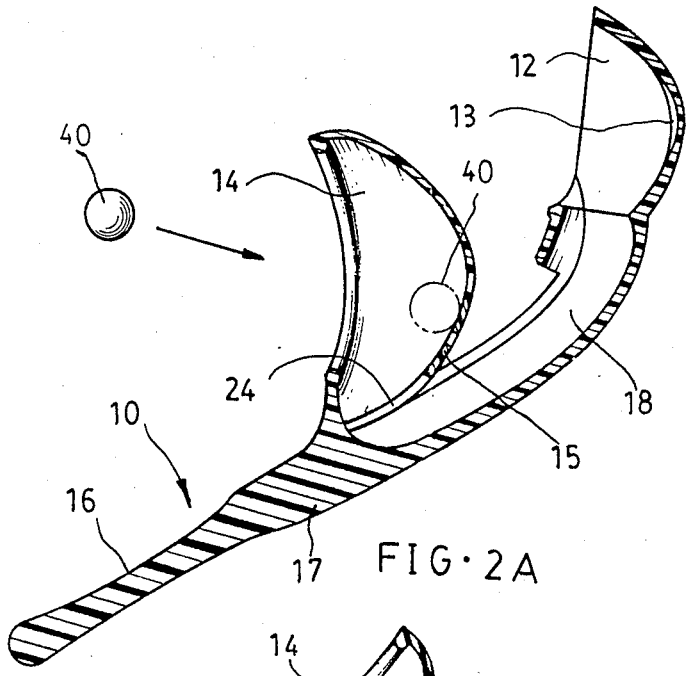
FIGS. 2A, 2B and 2C are sectional views across a line 2—2 in FIG. 1 to show relative position on a ball in the ladle-ball racket during receiving, stopping and serving respectively.

Please refer to FIG. 2A, the grip (16) can be held by both hands or one hand of a player. In order to receive a service or strike, the player should move himself and the racket (10) to a position that the receiving ladle (14) is at a point on the moving path of the ball (40). When the ball (40) reaches the belts (15) on the bottom of the receiving ladle (14), the belts can eliminate or buffer reacting force of the ball (40), or the player may, on the instant when the ball (40) impacts the belts (5), make use of the reacting force of the ball, turn the racket for a certain degree, and let the ball (40) falling into the ball passage (18) through the hole (24).

Figure 2B:
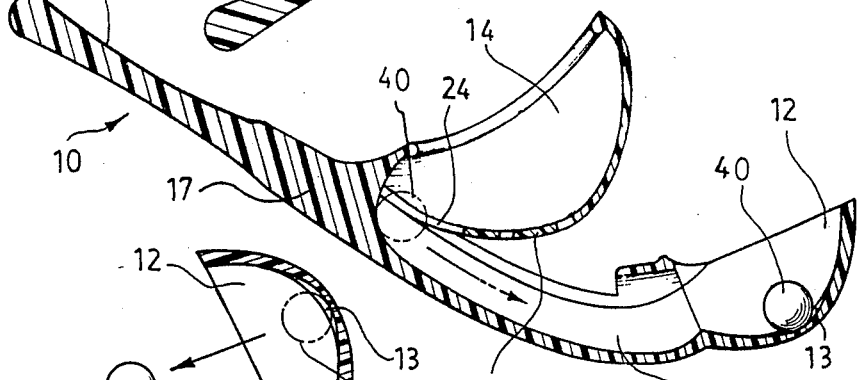

Please refer to FIG. 2B, for trapping and then stopping the ball (40) in the receiving ladle (14) or ball passage (18), the player should, according to the path of the moving ball (40), tilt the racket (10) downward slightly so that the ball (40) can pass the opening (25), and roll against the ball seat (13) on the bottom of the serving ladle (12) by gravity or remaining reacting force.

Figure 2C:
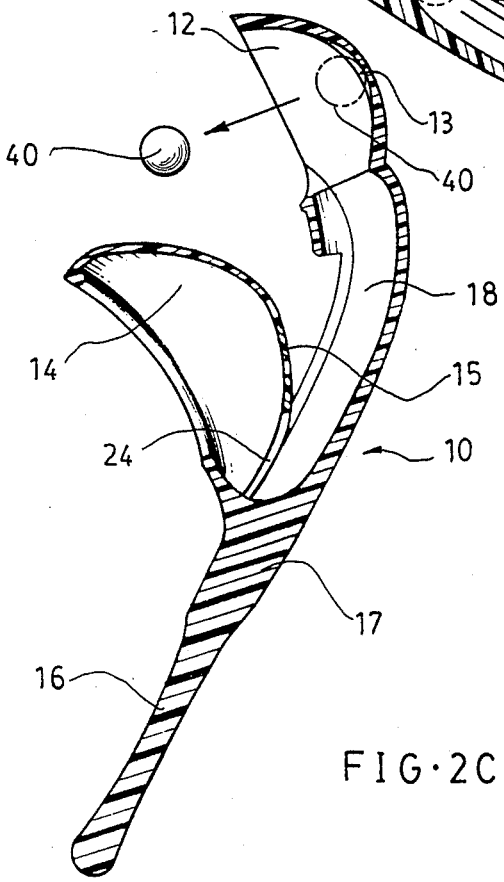

Please refer to FIG. 2C, after the ball (40) has reached the ball seat (13), the player can wave the racket (10) immediately or at any time so that the ball (4) at the ball seat (13) can fly away rapidly by the force of waving. The arm (17) acts as a lever to increase the force of waving and accelerate the speed of the ball (40).

The above description refers to an embodiment of a ladle-ball racket according to the present invention, for playing a game with one or more players.

For a one-player game, the rules for pelota may be applied. A player will first bat the ball to a wall, and then receive and serve the ball alternately after rebounding of the ball.

For a two-player game, the rules for badminton or the like may be applied except players are permitted to stop the ball and move after receiving the ball for considerations of stroke direction, strength, curvature, timing and other factors. For instance, the players may be allowed to move three steps and stop the ball for five seconds after receiving and before serving. As there is a certain time to handle the ball and the force of waving is relatively large, a court for the game must have appropriate size. The above rules give severe tests to players on moving and selection of position, skill of receiving and serving, judgement, decision, timing, etc.

For a game with more than two players, the rules for volleyball may be applied except players are allowed to stop the ball for a while and move a few steps before striking or passing the ball to their partners for the best attack effect.

The above embodiment is referred to describe in detail the objectives, characteristics and effect of the present invention. Any person skilled in the art can make alterations and/or modification of the above embodiment within the spirit of the present invention. Therefore, the scope of claims hereof shall be limited by the claims stated hereunder.

I claim:

1. A racket in the form substantially like a ladle, said racket comprising:

(a) a grip at the lower terminus;

(b) a serving ladle at the upper terminus; and (c) a receiving ladle below said serving ladle at a position in the middle between the grip terminus and the serving ladle terminus, said receiving ladle including a plurality of spaced belts to form a bottom; and (d) a walled ball passage formation extending between said serving ladle and said receiving ladle.

2. The racket according to claim 1, wherein the bottom of said serving ladle is in the form of a bowl positioned below the surface of the said passage.

3. The racket according to claim 1, wherein said grip, said ball passage and said serving ladle are included in a structure with a curvilinear configuration.

* * * * *